US008646951B2

(12) United States Patent
Kim et al.

(10) Patent No.: US 8,646,951 B2
(45) Date of Patent: Feb. 11, 2014

(54) ILLUMINATING APPARATUS

(75) Inventors: Jong Wook Kim, Gyeonggi-do (KR); Sang Hyun Shin, Gyeonggi-do (KR); Jin Sung Kim, Gyeonggi-do (KR); Eun Hee Nam, Gyeonggi-do (KR)

(73) Assignee: Wooree Lighting Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/501,503

(22) PCT Filed: Oct. 25, 2010

(86) PCT No.: PCT/KR2010/007327

§ 371 (c)(1),
(2), (4) Date: Apr. 12, 2012

(87) PCT Pub. No.: WO2011/052942

PCT Pub. Date: May 5, 2011

(65) Prior Publication Data

US 2012/0206928 A1 Aug. 16, 2012

(30) Foreign Application Priority Data

Oct. 26, 2009 (KR) ..... 10-2009-0101763

(51) Int. Cl.
*F21V 21/04* (2006.01)

(52) U.S. Cl.
USPC ..... 362/364; 362/148

(58) Field of Classification Search
USPC ..... 362/147, 148, 150, 285, 288, 289, 418, 362/404, 364, 365, 366
See application file for complete search history.

(56) References Cited

U.S. PATENT DOCUMENTS 4,211,955 A 7/1980 Ray
4,232,361 A * 11/1980 Kelsall ..... 362/364
4,630,183 A 12/1986 Fujita (Continued)

FOREIGN PATENT DOCUMENTS

JP 07-018313 3/1995
JP 2001-155530 6/2001

(Continued)

OTHER PUBLICATIONS

Japanese Office Action, with translation, issued in counter-part Japanese Patent Application No. 2012-536658, which claims the same priority as the instant application, dated Jul. 2, 2013, 4 pgs.

*Primary Examiner* — Laura Tso
(74) *Attorney, Agent, or Firm* — Harness, Dickey & Pierce, P.L.C.

(57) ABSTRACT

The present disclosure relates to an illuminating apparatus which is received at the back of an outer surface and which includes: a lighting part having a front surface, through which the light is irradiated, and a rear surface, which is the back side of the front surface; an electric connector electrically connected to the lighting part and coupled to a power supply at the back of the outer surface; and a length-adjustable shaft provided between the lighting part and the electric connector and bringing the rear surface of the lighting part into contact with the outer surface.

9 Claims, 11 Drawing Sheets

(56) References Cited

U.S. PATENT DOCUMENTS

| | | | | |
|---|---|---|---|---|
| 4,727,289 | A | 2/1988 | Uchida | |
| 5,072,345 | A * | 12/1991 | Goggia | 362/153.1 |
| 5,075,834 | A * | 12/1991 | Puglisi | 362/386 |
| 6,220,722 | B1 | 4/2001 | Begemann | |
| 6,764,204 | B1 * | 7/2004 | Peters | 362/429 |
| 7,771,085 | B2 * | 8/2010 | Kim | 362/285 |
| 2008/0080195 | A1 * | 4/2008 | Steadman et al. | 362/364 |

FOREIGN PATENT DOCUMENTS

| | | |
|---|---|---|
| JP | 2009-129631 | 6/2009 |
| KR | 20-1996-0023796 | 7/1996 |
| KR | 10-0635266 | 10/2006 |
| KR | 10-0920021 | 10/2009 |

* cited by examiner

ILLUMINATING APPARATUS

CROSS-REFERENCE TO RELATED APPLICATIONS

This application is a U.S. national stage filing under 35 U.S.C. §371 of International Application No. PCT/KR2010/007327 filed Oct. 25, 2010, 2010, and claims priority to Korean Application No. 10-2009-010763 Oct. 26, 2009. The disclosures of the aforementioned applications are incorporated herein by reference in their entireties.

FIELD

The present invention relates generally to an illuminating apparatus, and more particularly to an embedded-type illuminating apparatus which is embedded in an outer surface, such as the ceiling and the wall.

BACKGROUND ART

This section provides background information related to the present disclosure which is not necessarily prior art.

FIG. 1 is a view showing an illuminating apparatus in an installed state. An illuminating apparatus 10 is mounted such that it is embedded in the ceiling 20 or the wall. The illuminating apparatus 10 is not exposed to the outside since it is embedded in an outer surface such as the ceiling 20 or the wall, which leads to better appearance of the ceiling or the wall.

Meanwhile, an embedded part 30, in which the illuminating apparatus 10 is to be placed, is arranged already in an upper portion of the ceiling 20. The size of the embedded part 30, which is provided with a power supply 40, corresponds to the size of the illuminating apparatus 10. In other words, the embedded part 30 is designed to be suitable for the illuminating apparatus 10 of a given size. Therefore, if the size of the embedded part 30 does not match with the size of the illuminating apparatus 10, it is impossible for the illuminating apparatus 10 to be installed therein, which means that various sizes of existing embedded parts cannot be effectively used.

SUMMARY

Technical Problem

The problems to be solved by the present disclosure will be described in the latter part of the best mode for carrying out the invention.

Technical Solution

This section provides a general summary of the disclosure and is not a comprehensive disclosure of its full scope or all of its features.

According to one aspect of the present disclosure, there is provided an illuminating apparatus which is received at the back of an outer surface and which includes: a lighting part having a front surface, through which the light is irradiated, and a rear surface, which is the back side of the front surface; an electric connector electrically connected to the lighting part and coupled to a power supply at the back of the outer surface; and a length-adjustable shaft disposed between the lighting part and the electric connector and bringing the rear surface of the lighting part into contact with the outer surface.

Advantageous Effects

The advantageous effects of the present disclosure will be described in the latter part of the best mode for carrying out the invention.

BEST MODE FOR CARRYING OUT THE INVENTION

The present disclosure will now be described in detail with reference to the accompanying drawings.

Figure 1:
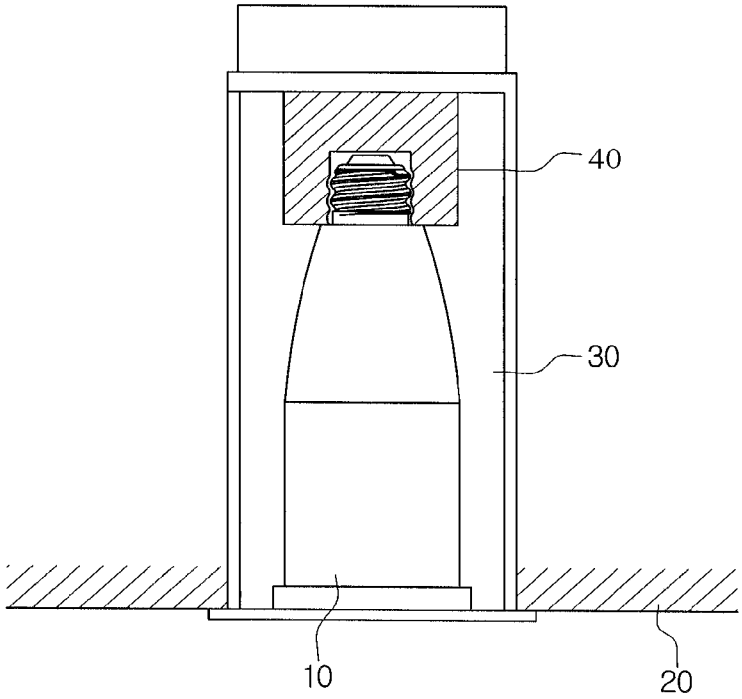
FIG. 1 is a view showing an illuminating apparatus in an installed state.
Figure 2:
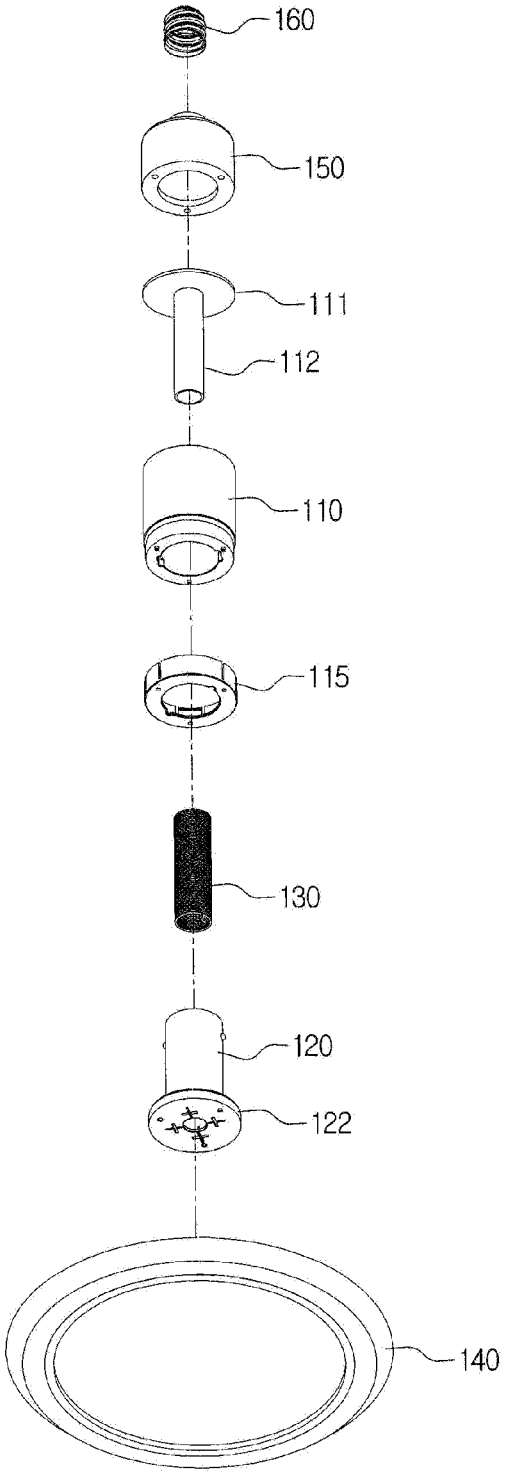
FIG. 2 is an exploded perspective view showing an illuminating apparatus according to an embodiment of the present disclosure.
Figure 3:
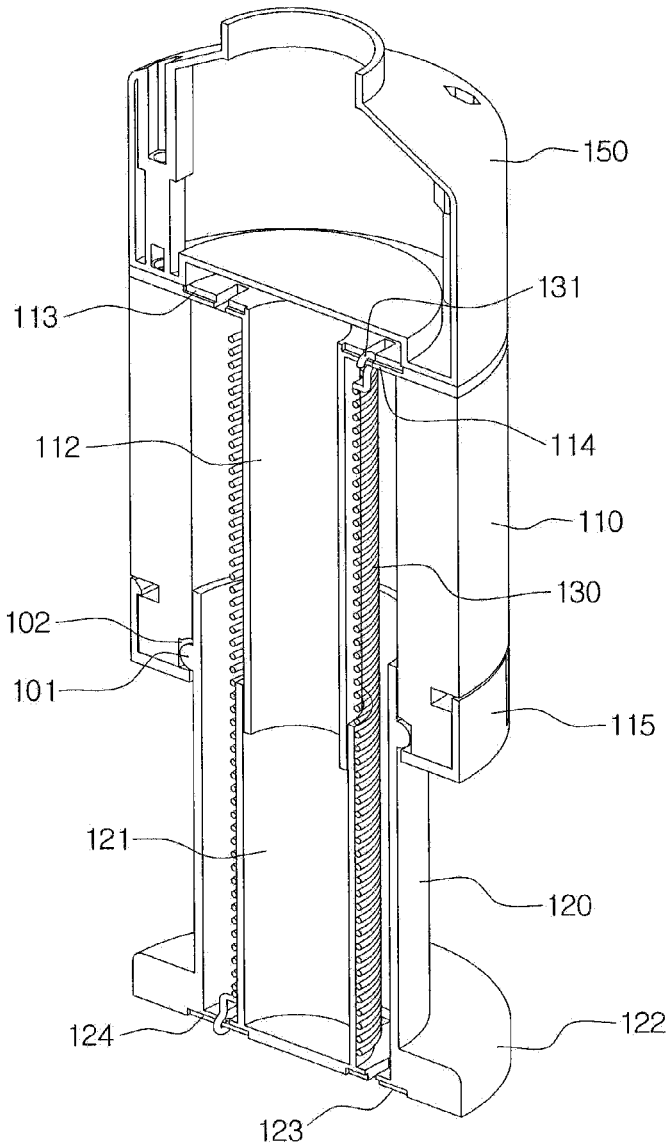
FIGS. 3 and 4 are cutaway perspective views showing an illuminating apparatus according to an embodiment of the present disclosure.
Figure 4:
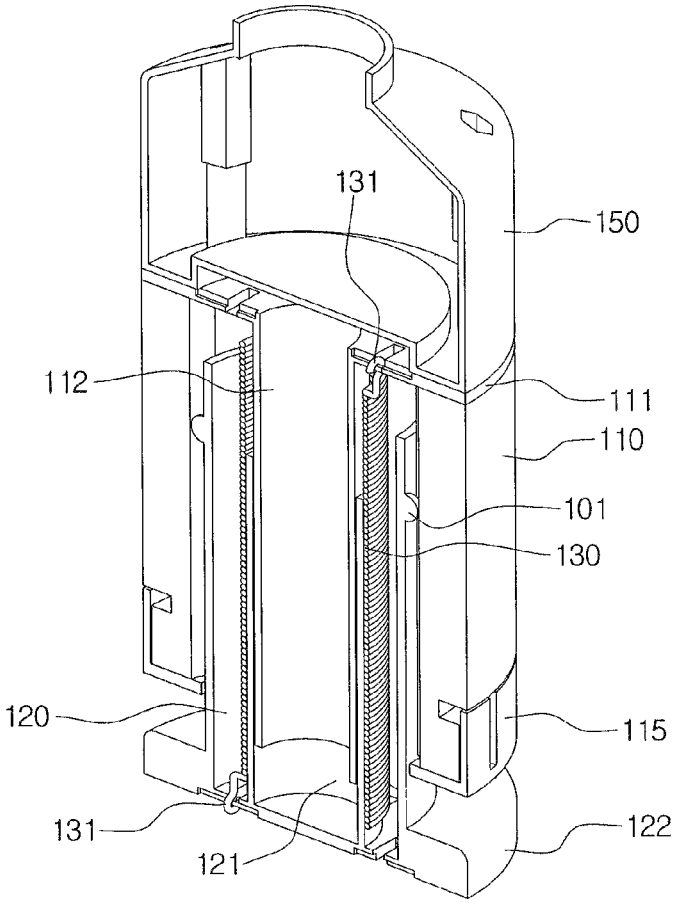

As illustrated in FIGS. 2, 3 and 4, an illuminating apparatus according to an embodiment of the present disclosure includes an upper shaft part 110 and a lower shaft part 120. The upper shaft part 110 and the lower shaft part 120 may be formed in a cylindrical shape. When they are coupled to each other, the upper shaft part 110 provides a sufficient space for the lower shaft part 120 to move forward and backward. Here, the inner circumference of the upper shaft part 110 corresponds to the outer circumference of the lower shaft part 120, such that the lower shaft part 120 moves, closely attached to the inner wall of the upper shaft part 110.

An upper cover 111 is provided at the top end of the upper shaft part 110, and a cylindrical upper guide member 112 is provided on one side of the upper cover 111. The upper guide member 112 serves to guide the forward and backward movement of a lower guide member 121 of the lower shaft part 120, which will be explained later, while providing a space for receiving elements such as an electric wire. Here, the upper cover 111 and the upper guide member 112 may be integrally formed.

The cylindrical lower guide member 121, which is concentric to the lower shaft part 120, is provided in the lower shaft part 120 and moves forward and backward along the upper guide member 112 when the lower shaft part 120 moves forward and backward in the upper shaft part 110.

There is a space between the inner wall of the lower shaft part 120 and the lower guide member 121, and a tension spring 130 is placed around the lower guide member 121, with both ends being fixedly connected to the upper cover 111 and a holder 122 of the lower shaft part 120, respectively. Thus, the upper shaft part 110 and the lower shaft part 120 are coupled to each other via the tension spring 130, so the lower shaft part 120 can move forward and backward according to the tensile force of the tension spring 130. Here, spring retaining pins 114 and 124 are provided on one side of the upper cover 111 and one side of the holder 122 of the lower shaft part 120, respectively, and fastened to hooks 131 provided at both ends of the tension spring 130, for fixing the tension spring 130. At this time, retaining pin seating parts 113 and 123, which are provided with the spring retaining pins 114 and 124, can be provided on one side of the upper cover 111 and one side of the holder 122 of the lower shaft part 120, respectively. In this embodiment, although the upper shaft part 110 and the lower shaft part 120 constitute a length-adjustable shaft by means of the spring 130, two shaft parts may constitute a length-adjustable shaft by means of a screw connection or the like.

Figure 5:
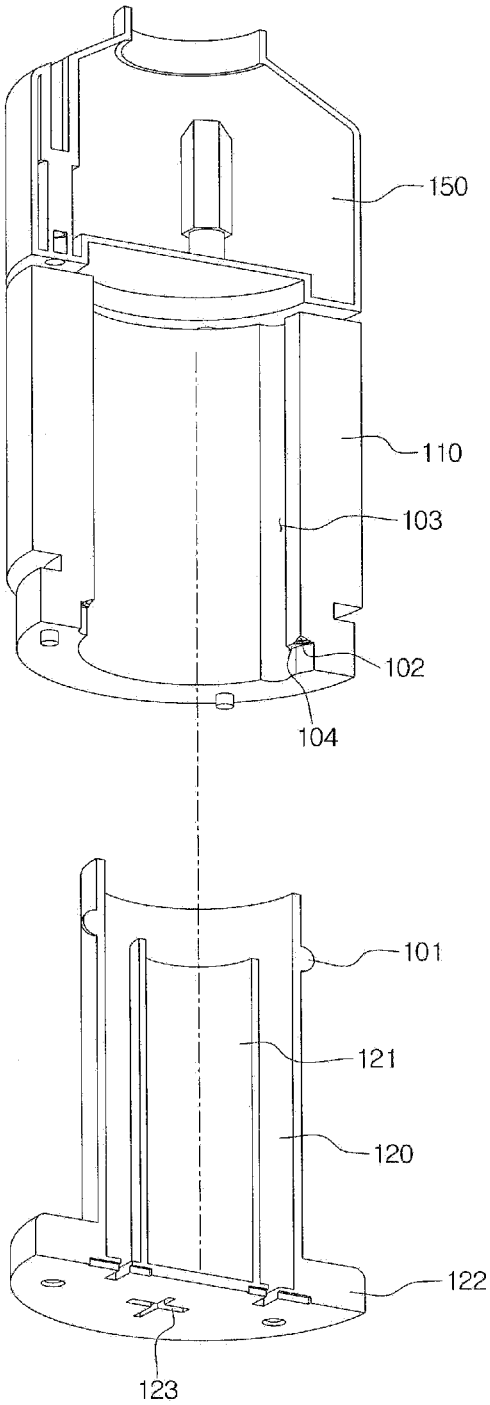
FIG. 5 is an exploded perspective view showing an upper shaft part and a lower shaft part.
Figure 6:
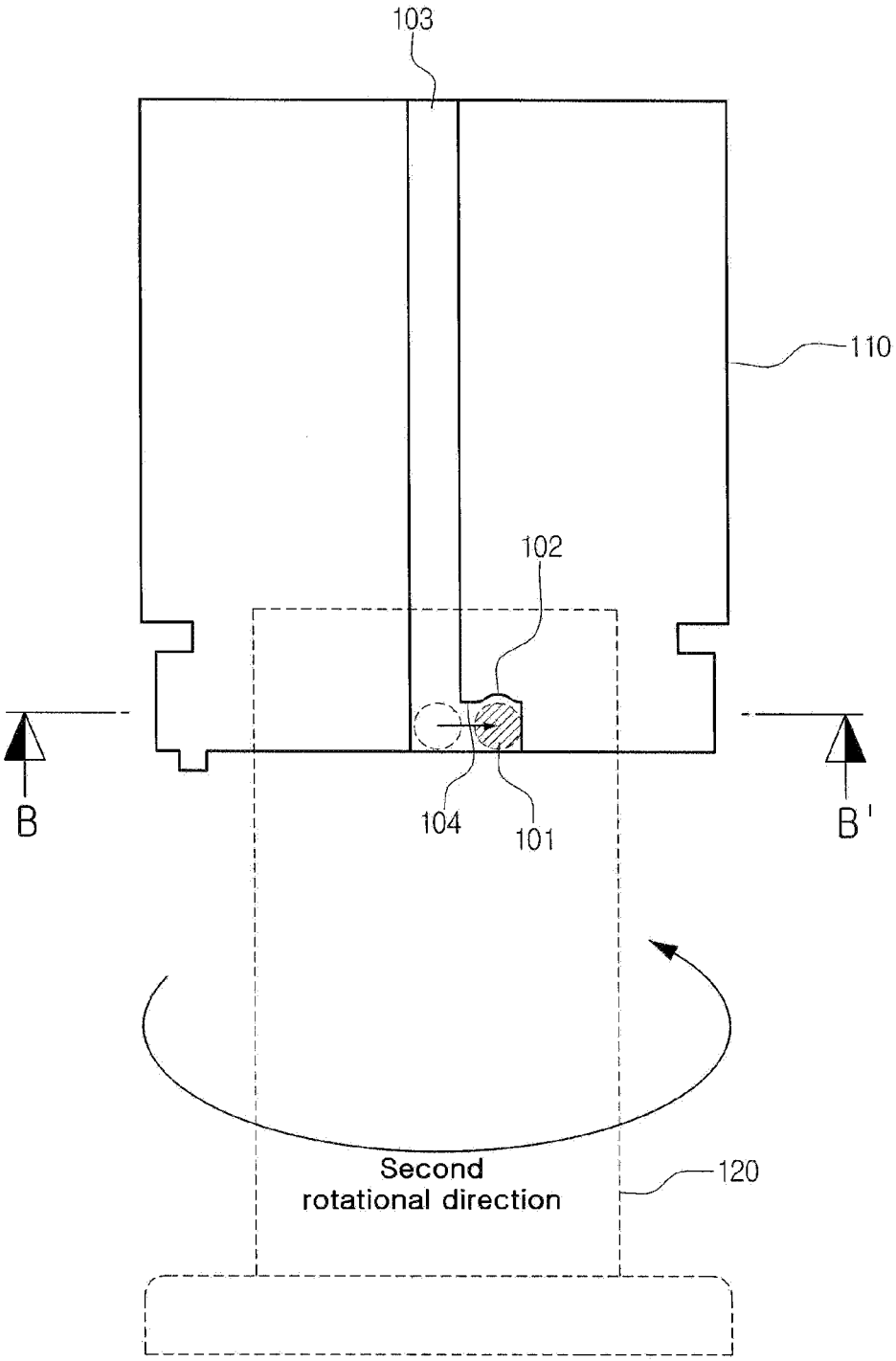
FIGS. 6 and 7 are sectional views for explaining the operation of an illuminating apparatus according to an embodiment of the present disclosure.
Figure 7:
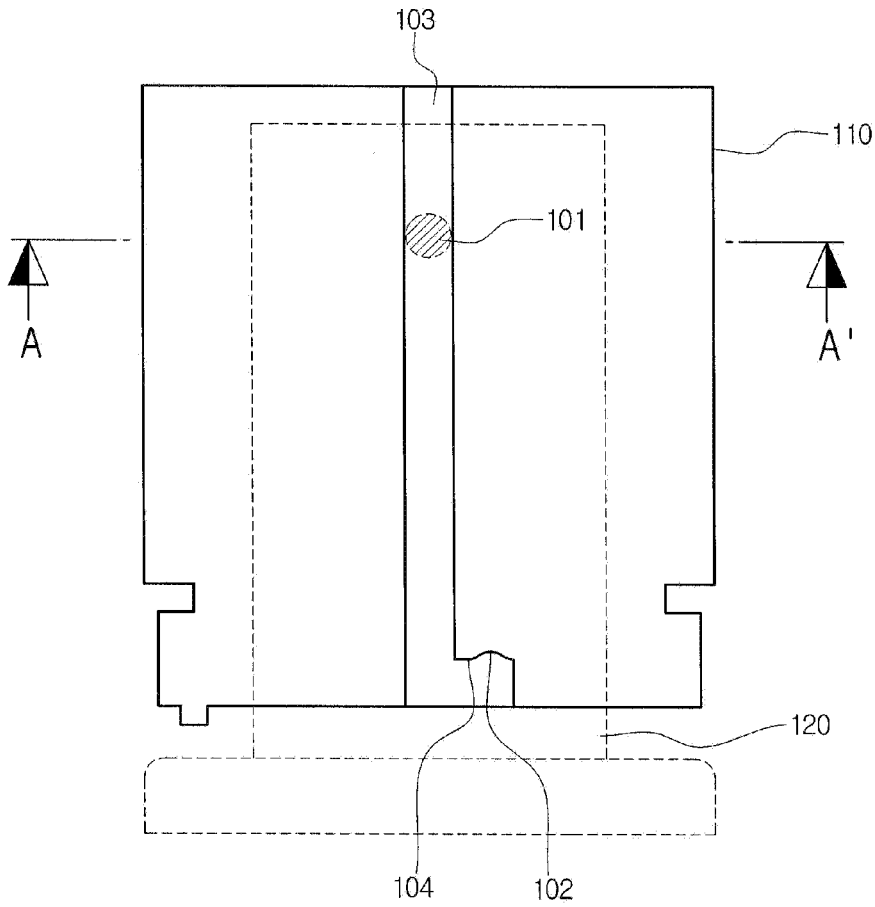
Figure 8:
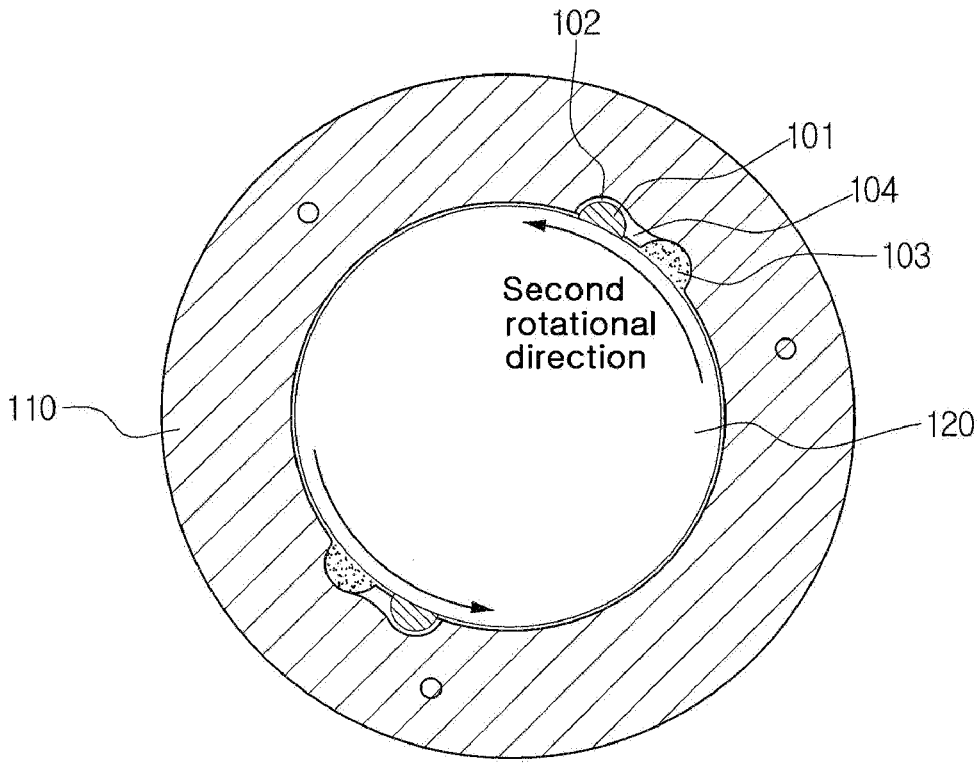
FIGS. 8 and 9 are sectional views taken along lines A-A' of FIG. 6 and B-B' of FIG. 7, respectively.
Figure 9:
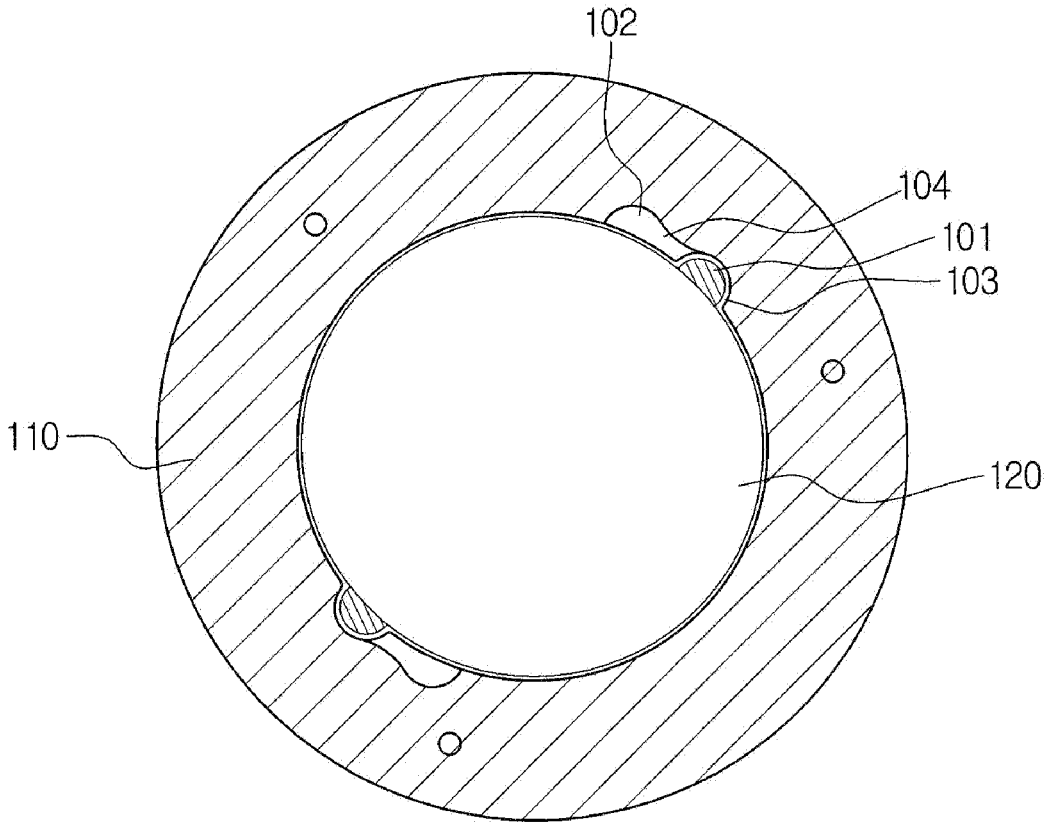
Figure 10:
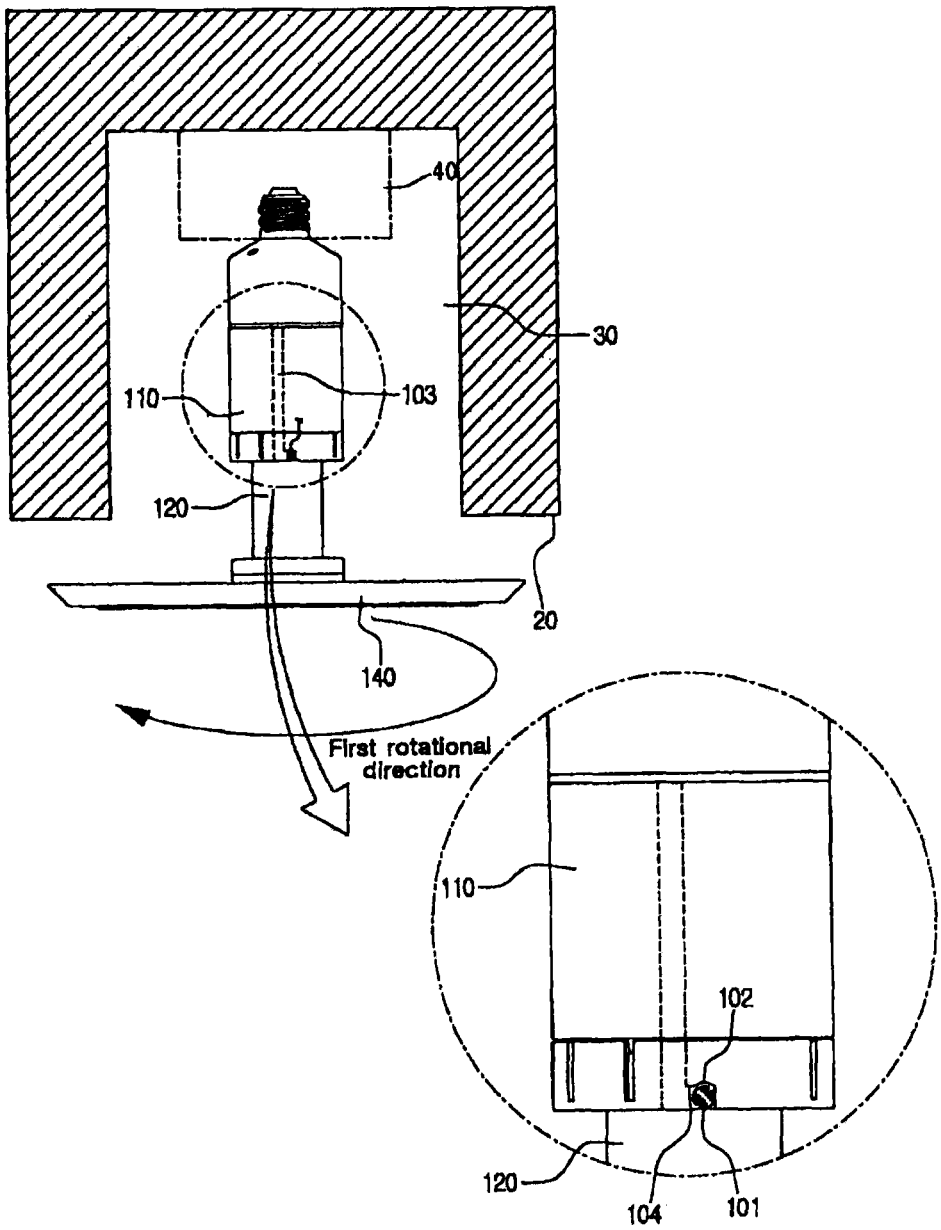
FIGS. 10 and 11 are reference views showing a process of an illuminating apparatus according to an embodiment of the present disclosure being mounted in an embedded part.
Figure 11:
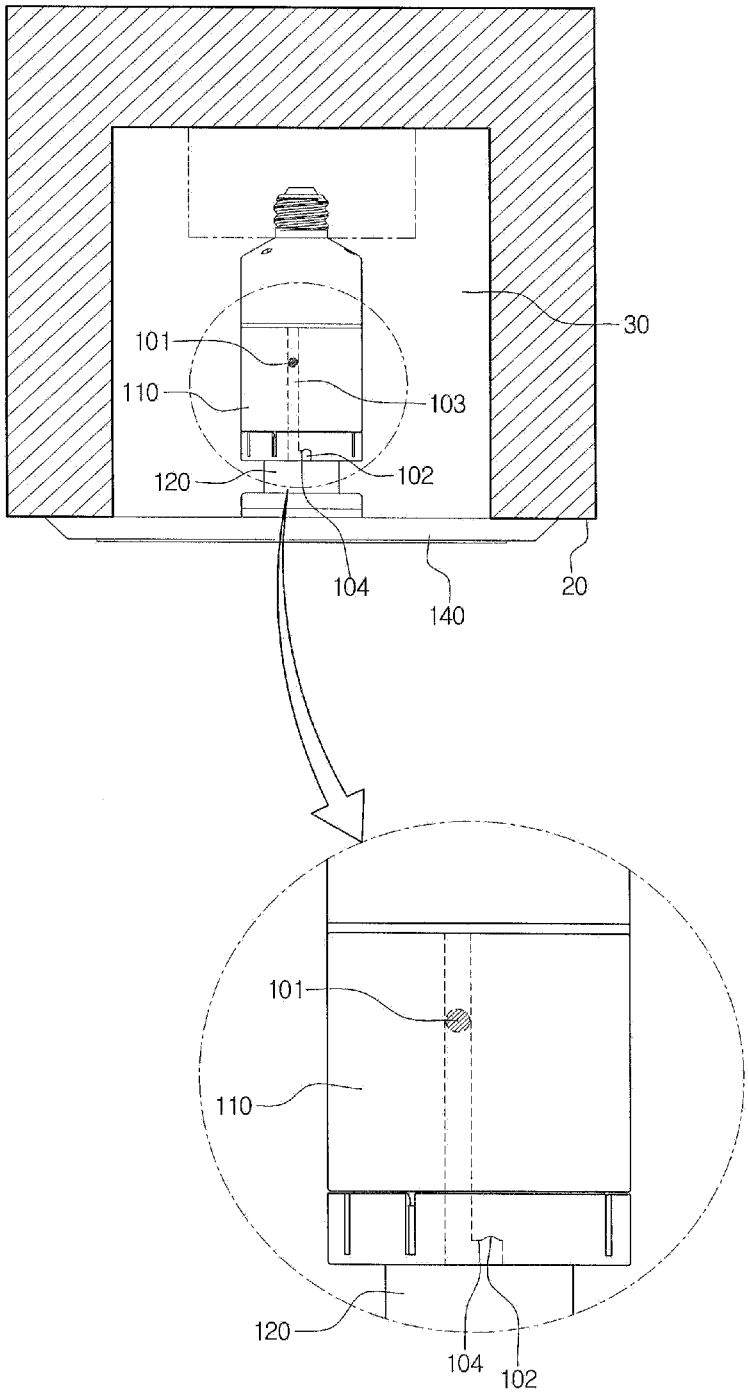

In the meantime, as shown in FIG. 5, a projection 101 is provided on one side of the lower shaft part 120, and a projection receiving part 102, which can receive the projection 101 of the lower shaft part 120, is provided on the inner wall of the upper shaft part 110. In addition, preferably, the projection 101 is provided at an upper end of the lower shaft part 120, while the projection receiving part 102 is provided at a lower end of the upper shaft part 110. Accordingly, when the projection 101 is coupled to the projection receiving part 102, the overall extended length of the upper shaft part 110 and the lower shaft part 120 approximates to the maximum. Here, there may exist two projections 101, and if a first projection is placed at 0°, a second projection can be placed at 180°. Furthermore, a first projection receiving part and a second projection receiving part, which correspond to the first projection and the second projection, respectively, may be provided on the inner wall of the upper shaft part 110.

Moreover, a projection guide slot 103, which provides a space for the projection 101 to move during the forward and backward movement of the lower shaft part 120, is formed on the inner wall of the upper shaft part 110 in the longitudinal direction. The projection guide slot 103 and the projection receiving part 102 are spatially connected to each other. While the space in the projection guide slot 103 is vertical, the space in the projection guide slot 103 and the space in the projection receiving part 102 are connected laterally. Therefore, the projection 101 vertically moves in the projection guide slot 103, and then laterally moves in the projection receiving part 102 to be received therein. The lateral movement of the projection 101 can be realized through the rotation of the lower shaft part 120. In this embodiment, although the projection guide slot 103 is disposed on the upper shaft part 110 and the projection 101 is disposed on the lower shaft part 120, they may be disposed vice versa.

A projection hooking part 104 is provided between the projection guide slot 103 and the projection receiving part 102. The purpose of the projection hooking part 104 is to independently secure the state of the projection 101 received in the projection receiving part 102 or the state of the projection 101 moving in the projection guide slot 103. In a state where the projection 101 is received in the projection receiving part 102, it is possible to forcibly apply a certain physical force to move the projection 101 into the projection guide slot 103 over the projection hooking part 104. On the contrary, it is also possible to move the projection 101 from the projection guide slot 103 into the projection receiving part 102. Here, it is preferable that the rotational direction from the projection receiving part 102 to the projection guide slot 103 should be set equal to the direction of fastening a socket base 160 to a socket. Although the projection 101 and the projection receiving part 102 are used as a stopper, the stopper may be realized in various ways. For example, a hole may be formed on the upper shaft part 110 and the lower shaft part 120 and a pin may be inserted into the hole.

Meanwhile, a lower cover 115 is provided at the bottom end of the upper shaft part 110 and serves to prevent the lower shaft part 120 from being detached from the upper shaft part 110. As described above, the projection guide slot 103 is provided in the longitudinal direction of the upper shaft part 110, and the lower shaft part 120 moves forward and backward in a state where the projection 101 is positioned in the projection guide slot 103. Here, the lower cover 115 interrupts the movement of the projection 101 to prevent detachment of the lower shaft part 120. Alternatively, an opening, which has a shape corresponding to the projection 101, may be formed on the lower cover 115 in a position which does not correspond to the projection guide slot 103, considering assembly and disassembly of the upper shaft part 110, the lower shaft part 120, and the lower cover 115.

In addition, a lighting part 140 is provided under the holder 122 of the lower shaft part 120. Example lighting parts include an LED lighting part, incandescent light, fluorescent light, etc. A housing 150 is also provided on the upper cover 111. If the LED lighting part is employed, an LED driving control module (not shown) for controlling the operation of the LED lighting part may be provided in the housing 150. With this, the socket base 160, on which the socket (not shown) is to be mounted, is provided at one end of the housing 150. The LED lighting part is especially suitable for the embedded-type illuminating apparatus according to the present disclosure, since it has a small thickness.

The configuration of the illuminating apparatus according to the embodiment of the present disclosure has been described above. Hereinafter, the operation of the illuminating apparatus according to the embodiment of the present disclosure having the above-described configuration will now be described. The illuminating apparatus according to the present disclosure is characterized in that it can be selectively applied to various lengths of embedded parts provided in the ceiling or the wall. The operation of the illuminating apparatus according to the embodiment of the present disclosure will be explained, based on a process of the illuminating apparatus being mounted in the embedded part.

First, in a state where all the components including the upper shaft part 110 and the lower shaft part 120 are assembled, the length of the illuminating apparatus according to the embodiment of the present disclosure is maximized. More specifically, in a state where the upper shaft part 110 and the lower shaft part 120 are compressed by the tension spring 130 to be coupled to each other, the lower shaft part 120 is extended until its projection 101 reaches a position corresponding to the projection receiving part 102 of the upper shaft part 110. At this time, the projection 101 of the lower shaft part 120 moves along the projection guide slot 103, and the tension spring 130 is stretched.

In this situation, the lower shaft part 120 is rotated so that its projection 101 can be received in the projection receiving part 102 of the upper shaft part 110 (see FIGS. 3, 6, 8 and 10). The rotation of the lower shaft part 120 can also be realized through the rotation of the lighting part 140 connected to the lower shaft part 120. Here, the rotational direction is opposite to the direction of fastening the socket base 160 to the socket (second rotational direction).

The projection 101 is received in the projection receiving part 102, which maintains the extended state of the upper shaft part 110 and the lower shaft part 120 and the stretched state of the tension spring 130. In this situation, the socket base 160 provided on one side of the illuminating apparatus according to the embodiment of the present disclosure is fastened to the power supply 40 provided in the embedded part 30 of the ceiling 20 (or the wall). Here, the length of the embedded part 30 is smaller than the extended length of the upper shaft part 110 and the lower shaft part 120, and the socket base 160 is rotated in the first rotational direction opposite to the second rotational direction so as to be fastened to the socket. In this embodiment, although the socket base 160 is used as an electric connector to be coupled to the power supply 40, various types of electric connectors such as a bi-pin-type electric connector may also be employed.

In a state where the socket base 160 is fastened to the socket, when a physical force is forcibly applied to further rotate the lower shaft part 120 in the first rotational direction, the projection 101 received in the projection receiving part 102 moves into the projection guide slot 103 over the projection hooking part 104, and the lower shaft part 120 moves fast toward the upper shaft part 110 due to the restoring force of the tension spring 130 (see FIGS. 4, 7, 9 and 11). As a result, the lighting part 140 provided at one end of the lower shaft part 120 is closely attached to the ceiling 20, so the illuminating apparatus is completely mounted in the embedded part 30. It may be contemplated that the first rotational direction and the second rotational direction are set equal. As a result, when the socket base 160 is coupled to the power supply 40, it can be more rigidly fixed by rotating the lighting part 140.

As set forth herein, when the length of the embedded part 30 is included in the extended length of the upper shaft part 110 and the lower shaft part 120, the illuminating apparatus can be mounted in the above manner, regardless of the length of the embedded part 30.

While the embedded part 30 has been described as a closed space, the illuminating apparatus according to the present disclosure can be used in any space having the power supply 40 and the outer surface 20.

Various embodiments of the present disclosure will now be described.

(1) An illuminating apparatus, wherein the length-adjustable shaft comprises a lower shaft part coupled to a rear surface and an upper shaft part coupled to the electric connector, and wherein the lower shaft part is urged by a spring to move toward the upper shaft part.

(2) An illuminating apparatus, wherein the relative movement of the lower shaft part to the upper shaft part is guided by a projection and a projection guide slot.

(3) An illuminating apparatus, wherein the illuminating apparatus further comprises a stopper for stopping the relative movement of the lower shaft part to the upper shaft part.

(4) An illuminating apparatus, wherein the stopper stops the relative movement through the relative rotation of the lower shaft part to the upper shaft part.

(5) An illuminating apparatus, wherein the electric connector is a socket base rotatably coupled to the power supply, and wherein the direction of the relative rotation is opposite to the rotational direction of the socket base.

(6) An illuminating apparatus, wherein the illuminating apparatus further comprises a projection receiving part which communicates with the projection guide slot and receives the projection during the relative rotation of the lower shaft part to the upper shaft part.

(7) An illuminating apparatus, wherein the illuminating apparatus further comprises a projection hooking part disposed between the projection guide slot and the projection receiving part.

(8) An illuminating apparatus, wherein the electric connector is a socket base rotatably coupled to the power supply, and wherein the direction of the relative rotation is opposite to the rotational direction of the socket base.

(9) An illuminating apparatus, wherein the lighting part is an LED lighting part.

An embodiment of the present disclosure provides a length-adjustable illuminating apparatus.

An embodiment of the present disclosure provides an illuminating apparatus which is not restricted by a given distance between a power supply and an outer surface.

An embodiment of the present disclosure provides an illuminating apparatus which is stably fixed to an outer surface.

An embodiment of the present disclosure provides an LED illuminating apparatus which does not excessively project from an outer surface.

The invention claimed is:

1. An illuminating apparatus, which is received at the back of an outer surface, wherein the illuminating apparatus comprises:

a lighting part having a front surface, through which the light is irradiated, and a rear surface, which is the back side of the front surface;

an electric connector electrically connected to the lighting part and coupled to a power supply at the back of the outer surface; and a length-adjustable shaft disposed between the lighting part and the electric connector and bringing the rear surface of the lighting part into contact with the outer surface, wherein the length-adjustable shaft comprises a lower shaft part coupled to the rear surface and an upper shaft part coupled to the electric connector, and wherein the lower shaft part is urged by a spring to move toward the upper shaft part, whereby the length of the length-adjustable shaft is adjusted.

2. The illuminating apparatus as claimed in claim 1, wherein the relative movement of the lower shaft part to the upper shaft part is guided by a projection and a projection guide slot.

3. The illuminating apparatus as claimed in claim 1, wherein the illuminating apparatus further comprises a stopper for stopping the relative movement of the lower shaft part to the upper shaft part.

4. The illuminating apparatus as claimed in claim 3, wherein the stopper stops the relative movement through the relative rotation of the lower shaft part to the upper shaft part.

5. The illuminating apparatus as claimed in claim 4, wherein the electric connector is a socket base rotatably coupled to the power supply, and wherein the direction of the relative rotation is opposite to the rotational direction of the socket base.

6. The illuminating apparatus as claimed in claim 2, wherein the illuminating apparatus further comprises a projection receiving part which communicates with the projection guide slot and receives the projection during the relative rotation of the lower shaft part to the upper shaft part.

7. The illuminating apparatus as claimed in claim 6, wherein the illuminating apparatus further comprises a projection hooking part disposed between the projection guide slot and the projection receiving part.

8. The illuminating apparatus as claimed in claim 7, wherein the electric connector is a socket base rotatably coupled to the power supply, and wherein the direction of the relative rotation is opposite to the rotational direction of the socket base.

9. The illuminating apparatus as claimed in claim 8, wherein the lighting part is an LED lighting part.

* * * * *